US010044106B2

(12) United States Patent
Lewis et al.

(10) Patent No.: US 10,044,106 B2
(45) Date of Patent: Aug. 7, 2018

(54) WIDE BAND ANTENNA

(71) Applicant: BAE SYSTEMS plc, London (GB)

(72) Inventors: Robert Alan Lewis, Chelmsford (GB); Murray Jerel Niman, Chelmsford (GB); Dean Kitchener, Chelmsford (GB); Christopher Bryce Wyllie, Chelmsford (GB)

(73) Assignee: BAE Systems plc, London (GB)

( * ) Notice: Subject to any disclaimer, the term of this patent is extended or adjusted under 35 U.S.C. 154(b) by 43 days.

(21) Appl. No.: 15/380,331

(22) Filed: Dec. 15, 2016

(65) Prior Publication Data

US 2017/0179605 A1 Jun. 22, 2017

(30) Foreign Application Priority Data

Dec. 18, 2015 (GB) ..... 1522357.1

(51) Int. Cl.

| | |
|---|---|
| ***H01Q 5/335*** | (2015.01) |
| ***H01Q 7/00*** | (2006.01) |
| ***H01Q 3/00*** | (2006.01) |
| ***H01Q 11/02*** | (2006.01) |
| ***H01Q 21/00*** | (2006.01) |

(52) U.S. Cl.

CPC ..... *H01Q 11/02* (2013.01); *H01Q 5/335* (2015.01); *H01Q 7/00* (2013.01); *H01Q 21/00* (2013.01)

(58) Field of Classification Search

CPC ..... H01Q 13/085; H01Q 7/00

See application file for complete search history.

(56) References Cited

PUBLICATIONS

Extended EP Search Report of EP Application No. EP15250022, dated Jun. 16, 2016, 8 pages.

A. Goard et al; "A transient UWB Antenna Array used with complex impedance surfaces", International Journal of Antenna and Propagation, vol. 12, No. 24, Apr. 9, 2010, pp. 329-8, XP055278410, ISSN: 1687-5869, DOI: 10.1109/8.59765.

Yu A Andreev et ak; "Combined antennas for radiating ultriwideband short pulses", 2008 5th European Radar Conference (Eurad 2008); Oct. 30-31, 2008, Amsterdam, Netherlands, IEEE, Piscataway, NJ, USA, Oct. 30, 2008, pp. 208-211, XP031411464, ISBN: 978-2-87487-009-5.

(Continued)

*Primary Examiner* — Dameon E Levi
*Assistant Examiner* — Ricardo Magallanes
(74) *Attorney, Agent, or Firm* — Maine Cernota & Rardin

(57) ABSTRACT

A wide band antenna comprising a signal generator coupled to a feed region of at least one antenna element comprising upper and lower loops. Upper loop comprising a first conductive loop element defined by an upper conductor and a first conductive blade tapering outwardly forming a flare portion adjacent a distal end of the upper conductor. Lower loop comprising a second loop defined by a base conductor and a second conductive blade tapering outwardly forming a flare portion adjacent a distal end of the base conductor, first and second conductive blades defining, between their facing edges, a notch opening outwardly from feed region. The method comprising matching an antenna element impedance to the transmission line; selecting an antenna element cut-off frequency; selecting an upper conductor length, and subsequently selecting dimensions of the upper loop such that they are substantially equal to a wavelength corresponding to the selected cut-off frequency.

12 Claims, 7 Drawing Sheets

(56) References Cited

PUBLICATIONS

Search report of Great Britain Application No. GB1522357.1, dated Jun. 9, 2016, 3 pages.
Extended EP Search Report of EP Application No. EP15250023, dated Jun. 8, 2016, 7 pages.
Godard A et al: "Size reduction and radiation optimization on UWB antenna", Radar Conference, 2008, Radar 09, IEEE, Piscataway, NJ, USA, May 26, 2008, pp. 1-5, XP031376259.
Desrumaux L et al: "Transient measurements of an agile UWB array", Wireless Technology Conference (EUWIT), 2010 European, IEEE, Piscataway, NJ, USA, Sep. 27, 2010, pp. 153-156, XP031784819.
GB Search Report of GB Application No. GB1522358.9, dated Jun. 9, 2016, 4 pages.
V I Kosheley eet al, "IEEE Pulsed Power Plasma Science Conference", 2001, vol. 2, pp. 1661-1664, "Ultrawideband radiators of high-power pulses".
Yu A Andreev et al, "IEEE 14th International Pulsed Power Conference", 2003, vol. 2, pp. 1458-1461, "High-power ultrawideband electromagnetic pulse source".
European Search Report of EP Application No. EP16203821, dated Apr. 7, 2017, 7 pages.

100

200

300

Test 1

Test 2

Test 3

Test 4

Test 5

400

500

600

Test 1

Test 5

700

WIDE BAND ANTENNA

RELATED APPLICATIONS

This application claims priority under the Paris Convention to GB patent application GB1522357.1, filed Dec. 18, 2015. This application is herein incorporated by reference in its entirety for all purposes.

FIELD

This invention relates, in a first aspect, to a method of manufacturing an antenna element; in a second aspect to an antenna element; and in a third aspect to a wide band antenna comprising an array of antenna elements.

BACKGROUND

Wide band technology is increasingly being developed for communications and other applications. Unlike narrow band systems, which operate at specific frequencies, wide band systems can transmit and receive sequences of very short pulses, i.e. pulses generated from a broad range or bandwidth of frequencies (typically several MHz to several GHz) of the electromagnetic spectrum. The input to a wide band antenna is typically from one or more pulsed sources, and the antenna is required to radiate incident energy into free space.

Clearly, optimising performance is a key consideration in antenna design. Regardless of the type and configuration of an antenna, its performance can be characterised by (at least) the following metrics:

i) Impedance bandwidth ii) Directive Gain iii) Efficiency

Antenna impedance, and the radio frequencies over which that impedance is maintained, are critical. It is essential that the antenna present an acceptable impedance match over the frequency band(s) of operation. Antenna impedance and the quality of the impedance match are most commonly characterized by either return loss (represented by the scattering parameter S11) or Voltage Standing Wave Ratio (VSWR)—these two parameters are simply different formats of exactly the same impedance data. S11 or return loss, then, is a measure of how much power is reflected back at the antenna port due to mismatch from the transmission line.

Bandwidth refers to the range of frequencies a given return loss can be maintained. Since return loss is a measurement of how much power the antenna accepts from the transmission line, the impedance of the antenna must match the impedance of the transmission line for maximum power transfer. However, the impedance of the antenna changes with frequency, resulting in a limited range (or ranges) that the antenna can be matched to the transmission line.

In general terms, gain is a key performance figure that combines the antenna's directivity and electrical efficiency. As a transmitting antenna, the figure describes how well the antenna converts input power into radio waves headed in a specified direction. The gain of an antenna will vary across its operating bandwidth, usually peaking at the or each resonant frequency.

Antenna efficiency is a measure of what portion of the power supplied to the antenna, including any reflection loss, is actually radiated by the antenna and it is well known in the art that, in order to maximise transmission efficiency, the impedance of the source can be matched, via the antenna, to that of the medium in which the signals are to be transmitted. The medium in which signals are to be transmitted is often free space.

Horn antennas have been used for many years as a means of matching the impedance of a transmission line to that of free space and directing the radiated energy in a controlled manner by virtue of their gain characteristics. The horn antenna can be considered as an RF transformer or impedance match between the waveguide feed (supplying the input signal) and free space which has an impedance of 377 Ohms.

An accepted method of broadening the range of frequencies over which a horn antenna is impedance-matched is to introduce ridges within the horn. These are often combined with a dielectric lens or tapered periodic surface in order to aid in limiting diffraction from the horn edges, thus helping to limit the beamwidth at low frequencies. The use of ridges essentially extends the upper frequency limit over which the antenna remains well matched, since this is a function of the aperture dimensions.

A horn antenna of the types described above could be designed which permits a significant proportion of the incident energy to be radiated over a broad band. However, for the proposed application, which may involve several high-power input sources, for example, several signal generators such as microwave frequency oscillators (MFOs), the inputs may first need to be combined before being fed to the single horn antenna. This is not generally considered to be feasible at high powers, principally due to the high risk of dielectric breakdown at the combined high power, and losses in the combination process. To overcome this problem, the available antenna aperture can instead be subdivided into a number of smaller regions, with sources attached to each region.

Alternative antenna designs comprise arrays of elements where the radiation from a number of such elements can be coherently summed in a particular direction to form a main beam. The aim in such an antenna design is to generate a single lobe from the antenna array, substantially uncorrupted by so-called grating lobes, which are spurious lobes resulting from standing waves in the elements. To minimise such grating lobe corruption, it is common for such arrays to be constructed so as to maximise the element spacing (thereby using a minimum number of elements whilst maintaining a sufficient impedance match for a specified area or aperture, to avoid the onset of grating lobes at particular scan angles. Such a spacing of elements tends to decrease efficiency due to compromised impedance matching.

Travelling wave antenna elements have been proposed for such antenna designs, for example, by Godard et al, "Size reduction and radiation optimization on UWB antenna", RADAR CONFERENCE, IEEE 2008. In this document, an antenna element is described having upper and lower conductive loop, the upper conductive loop comprising an upper conductor and a first conductive blade that tapers outwardly to form a flare portion adjacent a distal end of the upper conductor, the lower conductive loop comprising a base conductor and a second conductive blade that tapers outwardly to form a flare portion adjacent a distal end of the base conductor, the conductive loops being arranged and configured such that the outer edges of the first and second conductive blade members face each other to define a notch that tapers outwardly from the feed region of the antenna element. A conductive vane is provided between the upper conductor and the first conductive blade member to define two loops within the upper conductive loop. However, the antenna documented in this paper is designed to have one set of predefined characteristics for use in a very specific application, and the configuration of the antenna element (and the associated characteristics) are met, to a large extent, by experimentation. The field of travelling wave antennas has, thus far, received relatively very little attention compared with other types of antenna and, as such, although this and other academic papers exist that document specific travelling wave antenna designs, they provide little more general design principles for this type of antenna element that could be applied to a method of manufacturing such elements having differing characteristics and for different respective applications.

Thus, aspects of the present invention seek to provide a method of manufacturing a travelling wave antenna element that can be adapted to the manufacture of such elements having different respective performance characteristics to meet different respective needs.

More generally, aspects of the present invention seek to provide an efficient wide band antenna that radiates energy, possibly input from at least one high power pulsed source and fed via a co-axial line, into free space, which can be designed to have a predetermined cut-off frequency and its performance optimised over a specified frequency band of operation.

SUMMARY

In accordance with a first aspect of the present invention, there is provided a method of manufacturing a travelling wave antenna element, comprising the steps of:

selecting a desired cut-off frequency of the antenna element;

forming an antenna component having an upper and lower loop by:

providing a first conductive loop element defined by an upper conductor of length A and a first conductive blade member of length C that tapers outwardly to form a flare portion adjacent a distal end of the upper conductor;

providing a second conductive loop element defined by a base conductor and a second conductive blade member that tapers outwardly to form a flare portion adjacent a distal end of the base conductor;

providing a back plate that extends between and connects the proximal ends of the upper and base conductors such that the first and second conductive loop elements are located adjacent to each other with the outer edges of the first and second conductive blade members face each other to define a notch therebetween which opens outwardly from a feed region at or adjacent the back plate;

providing an elongate conductive vane between a first location on the upper conductor and a second location on the first conductive blade to define a pair of loops within the first conductive loop element; and matching an impedance of the antenna component, at a desired operating frequency range, to a transmission line to be connected at the feed region thereof;

wherein the step of providing the first conductive loop element comprises:

selecting the length A of the upper conductor in accordance with the desired cut-off frequency;

selecting the length C of the first conductive blade and the length B of the portion of the back plate extending between the upper conductor and the first conductive blade such that the sum of lengths A, B and C is substantially equal to a wavelength at the desired cut-off frequency.

In an exemplary embodiment, the method may further comprise selecting a predetermined performance characteristic of the antenna element, and the step of providing the elongate conductive vane may comprise:

selecting a minimum distance of the second location from the feed region at which the impedance match is maintained and the performance characteristic is attained, and placing the conductive vane within the first conductive loop element such that it extends from the selected second location on the first conductive blade to a first location on the upper conductor; and/or selecting an angle of inclination of the conductive vane within the first conductive loop at which the performance characteristic is attained, and placing the conductive vane at the selected angle of inclination between the first location on the upper conductor and the second location on the first conductive blade.

In this case, the method may include the step of selecting the second location as a function of the length of the upper conductor. Optionally, the second location on the first blade member is at least ⅙ of the length of the upper conductor. The distance of the second location from the feed region may be between ⅙ and ⅘ of the length of the upper conductor.

The conductive vane may be inclined outwardly, away from the feed region, such that the distance of the first location from the proximal end of the upper conductor is greater than that of the second location from the feed region. The conductive vane may be curved along at least a portion of its length.

The method may further comprise the step of selecting the distance of the first location from the proximal end of the upper conductor as a function of the length of the upper conductor and in accordance with the selected second location. In this case, for example, when the distance of the second location from the feed region is ⅙ of the length of the upper conductor, the distance of the first location from the proximal end of the upper conductor may be ⅕ or ¼ of the length of the upper conductor.

In an exemplary embodiment, the first location may be between ⅕ and ⅚ along the length of the upper conductor from its proximal end.

The elongate conductive vane may extend at an angle from the first location on the upper conductor to the second location on the first conductive blade member.

In accordance with another aspect of the present invention, there is provided an antenna element manufactured substantially as described above, and comprising an upper loop and a lower loop, the upper loop comprising a first conductive loop element defined by an upper conductor and a first conductive blade member that tapers outwardly to form a flare portion adjacent a distal end of the upper conductor, the lower loop comprising a second conductive loop element defined by a base conductor and a second conductive blade member that tapers outwardly to form a flare portion adjacent a distal end of the base conductor, the first and second conductive blade members defining, between their facing edges, a notch which opens outwardly from a feed region, the upper loop further comprising an elongate conductive vane extending at an angle from a first location on the upper conductor to a second location on the first conductive blade to define a pair of loops within the upper loop, the antenna element further comprising a back plate extending between the proximal ends of the upper and base conductors and wherein an impedance of the antenna element substantially matches, at a desired operating frequency range, an impedance of a transmission line to be connected at the feed region thereof; the length of the upper conductor corresponding to a desired cut-off frequency of the antenna element and the sum of the lengths of the upper conductor, the first conductive blade member and the portion of the back plate extending between the upper conductor and the first conductive blade member being substantially equal to a wavelength at the desired cut-off frequency.

In accordance with another aspect of the invention, there is provided a wide band antenna comprising a signal generator coupled, via one or more transmission lines, to a feed region of each antenna element of an array of antenna elements manufactured substantially as described above.

In accordance with yet another aspect, the invention provides a wide band antenna comprising an array of antenna elements substantially as described above.

Thus, more generally, the inventors have determined, through extensive innovative input, that the dimensions of the upper and/or lower loops can be selected according to a desired cut-off frequency of the antenna element, and the performance of the resultant antenna element, in a specified frequency range or ranges, can be optimised according to exemplary embodiments of the present invention. By changing the location and/or inclination relative to the feed region of the conductive vane within the upper loop, the performance of the antenna element can be optimised in respect of a predetermined desired operating frequency range. More specifically, the inventors have determined that by selecting the above-mentioned second location to be the minimum possible distance from the feed region without degrading the impedance match, the performance of the antenna element within the selected operating frequency range can be optimised. Furthermore, they have determined that characteristics or parameters of the antenna element can be influenced and optimised by selection of the inclination of the conductive vane (and, therefore, its length within an upper loop of given dimensions).

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

These and other aspects of the present invention will be apparent from the following specific description, in which embodiments of the present invention are described, by way of examples only, and with reference to the accompanying drawings, in which.

DETAILED DESCRIPTION

In the following exemplary embodiments, an antenna is configured to be driven by microwave frequency oscillators (MFOs). However, it will appreciated that the present invention is not intended to be limited in this regard and that other multi-frequency pulsed energy sources can be used.

Throughout the specification, references are made to components being 'outward' or 'inward'. The term 'outward' has been used to indicate a direction that is towards the medium into which the antenna radiates (often referred to as boresight), and 'inward' is used to indicate the opposite direction, i.e. away from the medium into which the antenna radiates. Furthermore, relative terms such as 'upper' and lower, and row and column, are used for convenience to distinguish between components so as to better explain the invention, so no absolute orientation is intended from the use of such terms alone.

Ultra Wide band (UWB) radiating systems with a peak power of around $10^{10}$ W are necessary for many applications. As explained above, creation of this type of radiating system has been achieved on the basis of multi element arrays with a peak radiation power of a single array element of around 0.1-1 GW.

An antenna element has been proposed for this purpose in Koshelev, et al, "High-Power Ultrawideband Radiation Source with Multielement Array Antenna", in Proceedings of the 13th International symposium on High Current Electronics, Tomsk, Russia, July 2004. The described antenna element comprises an upper loop and a lower loop. The upper loop comprises a conductive loop defined by a first elongate conductor and a first conductive blade member that tapers outwardly to form a flare portion adjacent a distal end of the first elongate conductor. The lower loop comprises a conductive loop element defined by a second elongate conductor and a second conductive blade member that tapers outwardly to form a flare portion adjacent a distal end of the second elongate conductor, with the first and second conductive blade members defining, between their facing edges, a notch which opens outwardly from a feed region. It is to be appreciated that the term 'distal' used above and hereinafter is intended with reference to the feed region, i.e. outward from the feed region, and the term 'proximal' used above and hereinafter is intended with reference to the feed region, i.e. closer or closest to the feed region. An antenna comprising a 4×4 array of such antenna elements is described, wherein the source comprises a pulse generator feeding the antenna via four co-axial transmission lines (i.e. one feeding each row of antenna elements).

Figure 1A:
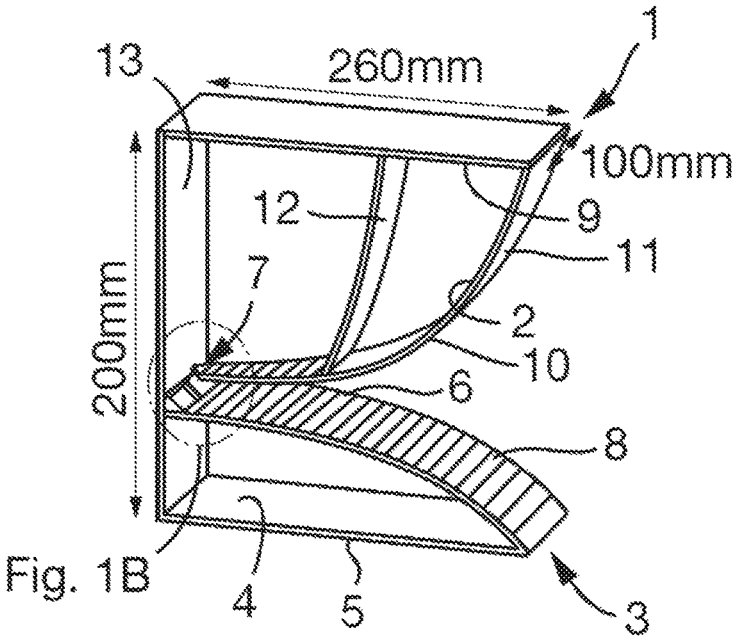
Fig. 1A Prior Art
FIG. 1A is a schematic perspective view of an antenna element according to the prior art.

This type of antenna element was further explored by Godard, A., et al, "A transient UWB Antenna Array Used with Complex Impedance Surfaces", Hindawi, International Journal of Antennas and Propagation, Vol. 2010, wherein a modified antenna element is proposed that includes a conductive vane extending at an angle from the first conductive blade member to the upper elongate conductor so as to form a pair of adjacent loops. Such an antenna element is illustrated schematically in FIG. 1A of the drawings, in which it can be seen that the element comprises an upper loop 1 comprising a first conductive loop element 2 and a lower loop 3 comprising a second conductive loop element 4. The conductive loop element 2 of the upper loop 1 comprises an elongate upper conductor 9 and a first conductive blade member 10, the first conductive blade member tapering outwardly from a feed region 7 to the distal end of the upper conductor 9 to form a first flare 11. The conductive loop element 4 of the lower loop 3 comprises an elongate base conductor 5, oriented substantially parallel to the upper conductor 9, and a second conductive blade member 6 which tapers outwardly from the feed region 7 to the distal end of the base conductor 5 to form a second flare 8.

Figure 1B:
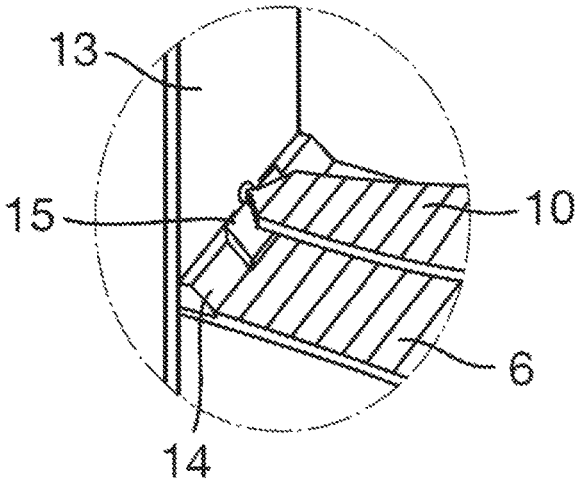
Fig. 1B Prior Art
FIG. 1B is a close-up schematic view of the feed region of the antenna element of FIG. 1A.

A conductive vane 12 extends at an angle across the conductive loop of the monopole member, between the second blade member and the upper conductor, the vane 12 being inclined outwardly, i.e. away from the feed region 7. The feed region 7 is defined at a back plate 13. The connection or transition between the first blade member 6 and the inner surface of the back plate 13 is designed to achieve a good impedance match (S11 parameter lower the −10 dB) over a desired frequency band (300 MHz-3 GHz). As shown in FIG. 1B of the drawings, the transition is formed of two sections: a first section 14 formed of metal and a second, central section 15 formed of, for example, PTFE, that provides high-voltage resistance.

However, it will be appreciated, that the described antenna element is intended for a specific use and frequency range, and has been developed and optimised for that use and frequency range. In contrast, an object of exemplary embodiments of the present invention is to provide a method of antenna design that permits the design of an antenna element with a specified cut-off frequency within specified physical and/or dimensional constraints, and permits the performance of such an antenna element or a wide band antenna comprising an array of such elements to be optimised according to specified characteristics, without increasing the dimensions of the antenna element to levels that would make it impractical for many applications, such method being readily adaptable to various different applications and respective performance characteristics to be attained.

The object of the above-mentioned reference (Godard) is to present a miniature antenna element which can be shown to have a cut-off frequency of 363 MHz. This characteristic is determined by the external characteristics of the antenna element, i.e. height H, length L and width W. In order to reduce the cut-off frequency of the element, it would be necessary to increase the external dimensions significantly, with the result that the antenna element, and any resulting multi-element array antenna would have impractically large dimensions for many applications, and may have an inadequate performance at various frequency ranges. Using the design calculations employed by Godard et al, a cut-off frequency of around 100 MHz, would require an antenna element of dimensions:

W=3000/10=300 mm

H=3000/5=600 mm

L=3000/3.85=780 mm

Thus, the width of each antenna element would have to be 300 mm. However, this also has additional drawbacks in terms of heat dissipation and, therefore, a negative effect on efficiency of the antenna element. Also, such dimensions may make it difficult to impedance-match the antenna element, or a multi-element antenna, to the transmission lines (s), which is a significant drawback as the feed design is, in many cases, critical to driving the antenna. Furthermore, such dimensions would not provide an optimised performance at specified frequencies and frequency ranges, and no methods or techniques are proposed in the prior art for solving these issues.

It is, therefore, an object of optional aspects of the invention to provide a method of antenna design, wherein its performance can be optimised at a specified operational frequency range and with reduced dimensions compared with known techniques.

In accordance with an exemplary embodiment of the present invention, this object may be achieved by altering the location and/or the inclination of the conductive vane defining the double loop in the upper loop of an antenna element of the type described above.

Figure 2:
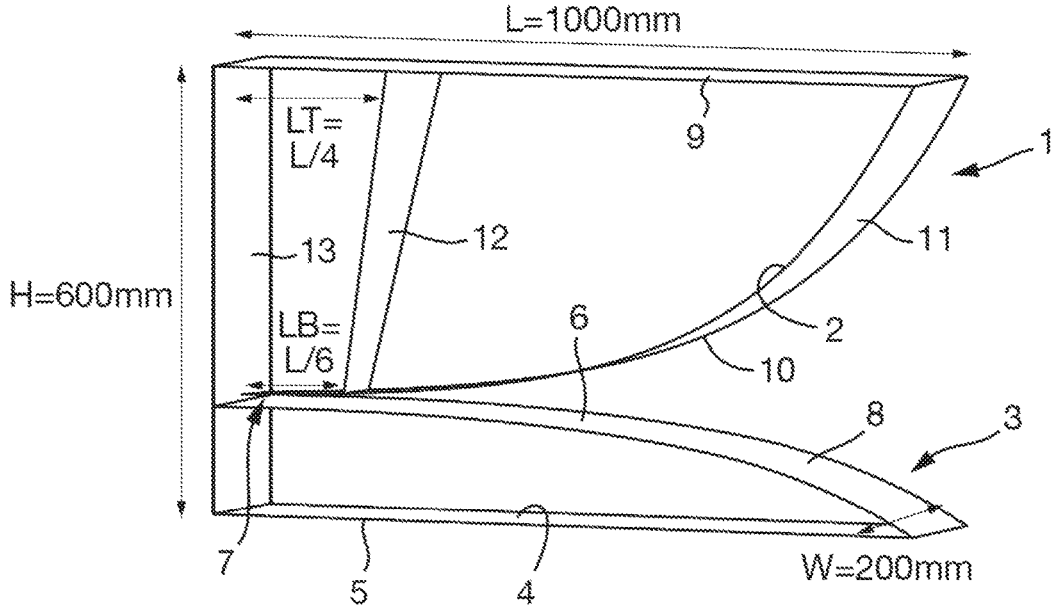
FIG. 2 is a schematic side view of an antenna element according to an exemplary embodiment of the present invention.
Figure 3A:
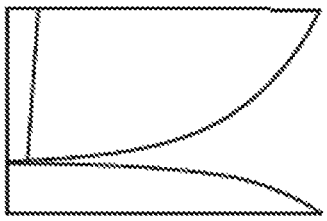
FIGS. 3A to 3E illustrate schematically various configurations of an antenna element according to an exemplary embodiment of the present invention, with progressively increasing distances of the conductive vane from the feed region of the antenna element.
Figure 3B:
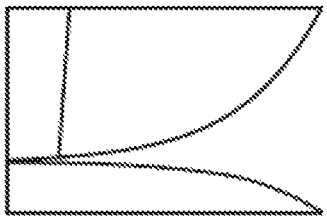
Figure 3C:
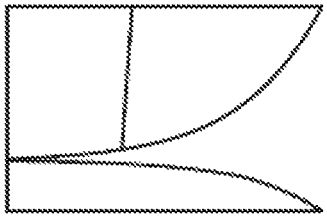
Figure 3D:
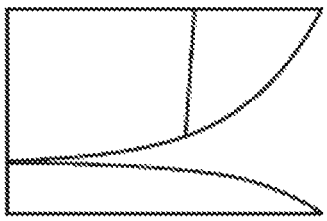
Figure 3E:
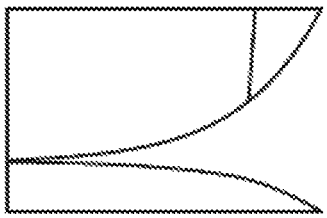

Referring to FIG. 2, in an exemplary embodiment of the invention, the antenna element structure proposed is of the type described above, but having the following dimensions:

W=200 mm;

H=600 mm;

L=1000 mm;

which dimensions are selected to provide a cut-off frequency of ~100 MHz.

In a method of manufacture according to an exemplary embodiment of the invention, impedance matching is performed to match the impedance of the antenna element to the transmission line of the desired radiation source (in a known manner) and the feed region 7 is thus optimised. Next, a selected operating frequency range for which the antenna element performance is to be optimised is selected. In this example, the frequency range is 400-700 MHz.

Figure 6F:
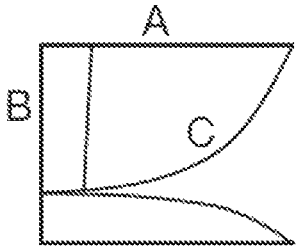
FIGS. 6(F) to 6(J) illustrate various configurations of an antenna element according to an exemplary embodiment of the present invention, with progressively increasing inclinations of the conductive vane.
Figure 6G:
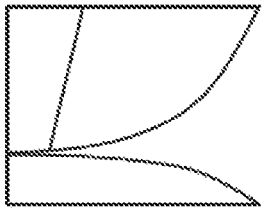
Figure 6H:
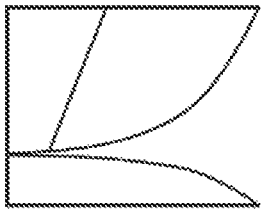
Figure 6I:
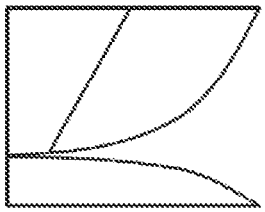
Figure 6J:
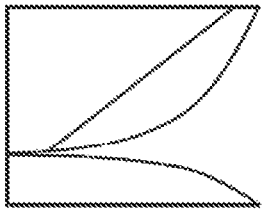

Referring to FIG. 6(J) of the drawings, the length of the upper conductor is denoted 'A', the length of the first conductive blade member is denoted 'C', and the length of the portion of the back plate extending between the upper conductor and the first conductive blade member at the feed region is denoted 'B', wherein the sum of these dimensions (A+B+C) comprises the total 'circumference' of the upper conductive loop. In a method according to the invention, the required cut-off frequency of the antenna is first selected according to the specific requirements of the application at issue. The length A of the upper conductor is then selected to meet the selected cut-off frequency. Thus, in the example illustrated in FIG. 2 of the drawings, for a cut-off frequency of ~100 MHz, a length A of the upper conductor is selected to be 1000 mm. the inventors have determined, through extensive innovative effort, that, once the length of the upper conductor 9 has been selected, the overall size of the antenna can be optimised and/or 'tailored' to the specific application simply by selecting the other two dimensions (B and C) of the upper conductive loop such that the sum A+B+C is substantially equal to a wavelength at the selected cut-off frequency, without being further constrained. Thus, if a particular length of B is dictated by the physical and/or dimensional constraints of the application in which the antenna element is to be used, then the designer has the freedom to utilise that particular length and then select the length C of the first conductive blade member to make the circumference of the upper conductive loop substantially equal to a wavelength at the selected cut-off frequency. It will be clear then, that once the length of the upper conductor has been selected to correspond with the selected cut-off frequency, the proposed design principle provides two degrees of freedom in relation to the upper conductive loop of the antenna element, which is hugely advantageous in comparison with the methods of antenna design and manufacture previously documented, and the width of the resultant antenna element can, as a result, be made much smaller than that of prior art antenna elements, if required.

Referring back to FIG. 2 of the drawings, the required performance characteristics of the antenna element can be improved by the provision of a conductive vane 12 between the upper conductor 9 and the first conductive blade member 10 to form a double loop configuration within the upper conductive loop 1.

The inventors have further determined that by selecting the location of the conductive vane 12, the performance of the antenna element in the operating frequency range 400-700 MHz can be further optimised (in terms of return loss and efficiency.

Referring to FIG. 3 of the drawings, 5 possible locations of the conductive vane are illustrated, as A, B, C, D and E respectively. The inventors have determined, through extensive innovative input, that the key aspect of this element of the design method is the distance from the feed region 7 of the end of the conductive vane 12 where it meets the blade member of 10. In each of the five illustrated tests A-E, the inclination of the vane 12, outward, is substantially the same, at less than 10 degrees relative to a vertical axis defined by the back plate 13, and the above-mentioned distance from the feed region 7 of the vane 12 where it meets the blade member 10 is made progressively larger.

Figure 4:
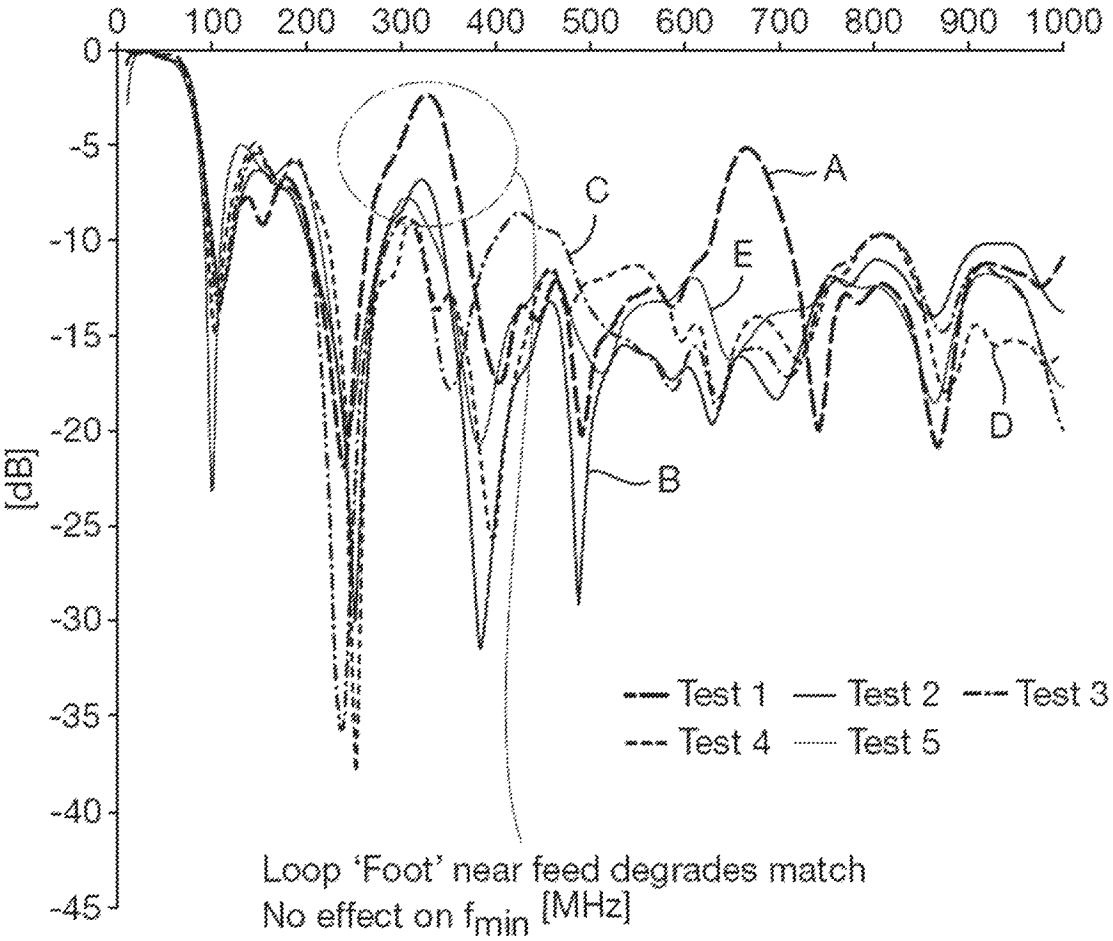
FIG. 4 is a graphical representation of test results for each of the five configurations illustrated in FIG. 3.

As illustrated in FIG. 4 of the drawings, it can be seen that if this distance is too small, the impedance match is degraded and the return loss (S11) is increased above an acceptable level at some frequencies. However, it can be seen that the performance of the antenna in the frequency range 400-700 MHz is significantly improved in tests B, C and D at least (i.e. with the above-mentioned distance between about L/6 and 5L/8.

Figure 5:
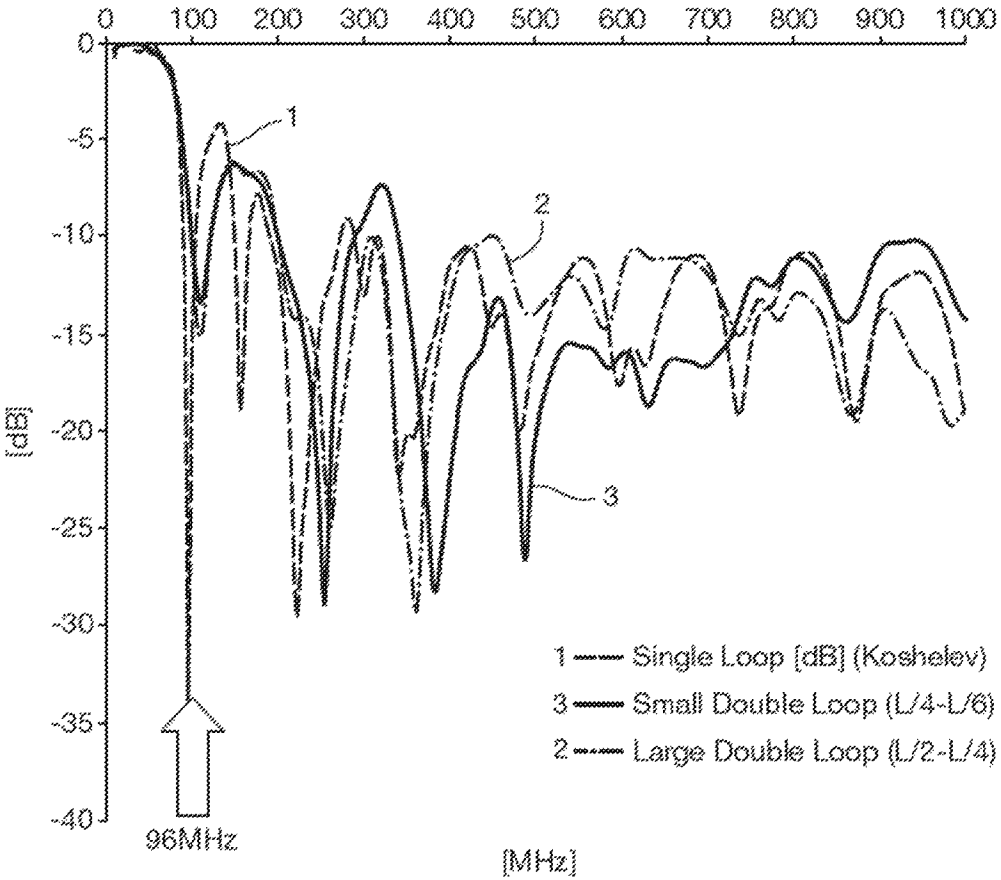
FIG. 5 is a graphical representation of calculations of performance from an antenna element according to an exemplary embodiment of the present invention compared with test results from two antenna elements according to the prior art.

This performance can be seen in FIG. 5 (reference 3) in comparison to that achieved with a comparably sized antenna element having (1) a single loop (Koshelev) and (2) a much larger double loop (Godard), wherein the above-mentioned distance is L/4 and the inclination of the vane is such that the distance of the other end of the vane from the proximal end of the upper conductor is L/2.

Referring now to FIG. 6 of the drawings, having determined the optimum distance from the feed region of the conductive vane where it meets the blade member, the inventors have determined that the performance of the antenna element can be further optimised by changing the length of the inner loop (closest to the feed region). In effect, this method step comprises selecting an inclination of the conductive vane (outward) relative to the vertical axis defined by the back plate, or (equally) selecting the distance from the proximal end of the upper conductor of the conductive vane where it meets the upper conductor.

Figure 7:
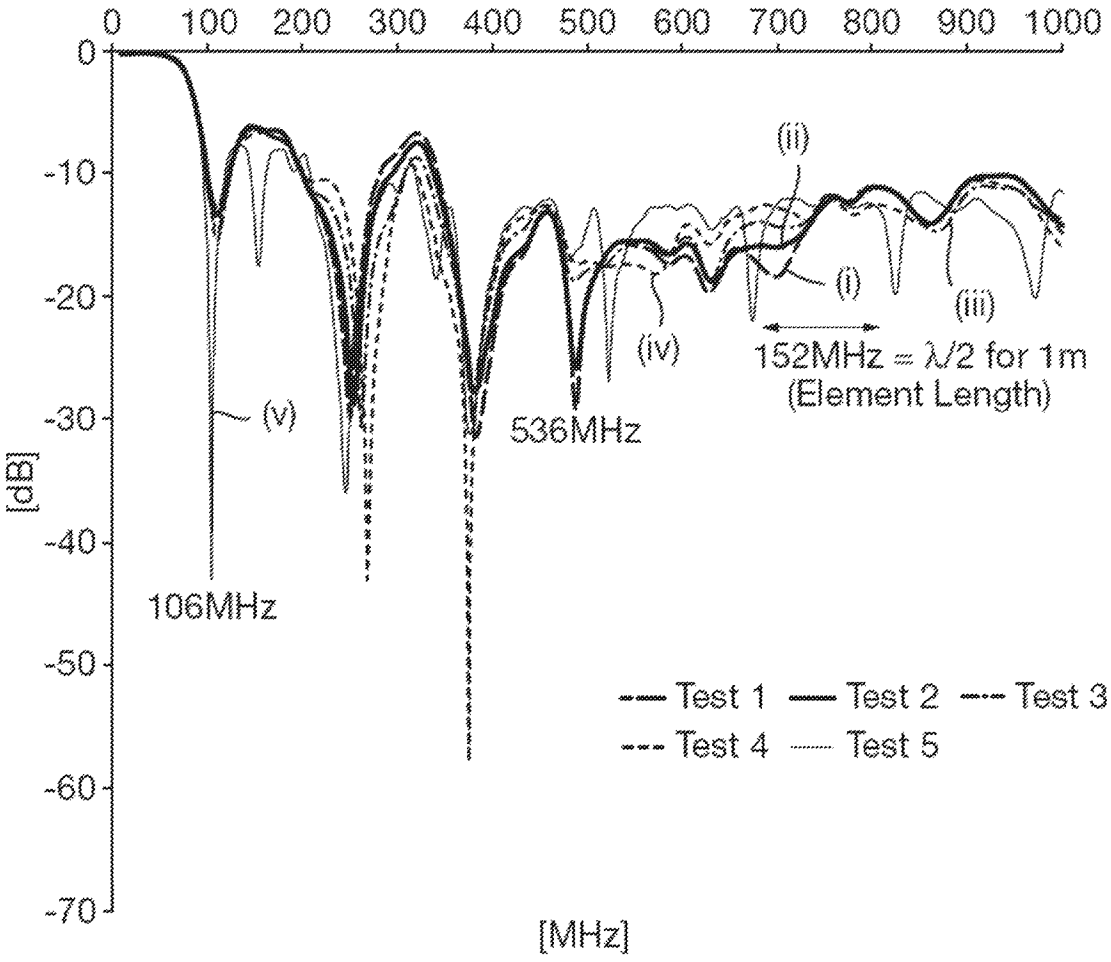
FIG. 7 is a graphical representation of calculations of performance for each of the five configurations illustrated in FIG. 6.

In the examples shown in FIG. 6, each of the configurations tested has a 'bottom' distance (from the feed region) of around L/6 (corresponding to Test B of FIG. 3), and each of the test configurations has a progressively larger loop length, ranging from about L/5 in test (F) to around 4L/5 in test (J). Thus, as shown in the calculated results illustrated in FIG. 7 of the drawings, the performance of the antenna element can be optimised for a specified operating frequency range (in this case, 400-700 MHz) by maintaining the minimum 'bottom' distance of the conductive vane (whilst maintaining the required impedance match), but increasing the size of the inner loop by increasing the 'top' distance (from the proximal end of the upper conductor) or inclination of the conductive vane. In view of the increased length of the upper and/or lower loops in comparison to the above-referenced Godard design, the antenna performance is further optimised by the methods proposed herein.

Thus, more generally, the cut-off frequency of the antenna can be selected and the loop length/dimensions selected to achieve that selected cut-off frequency. The performance of the resultant antenna can then be optimised for a specified frequency range or ranges using methods according to exemplary embodiments of the present invention.

It will be apparent to a person skilled in the art, from the foregoing description, that modifications and variations can be made to the described embodiments without departing from the scope of the invention as defined by the appended claims. The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A method of manufacturing a travelling wave antenna element, comprising the steps of:

selecting a desired cut-off frequency of said antenna element;

forming an antenna component having an upper and lower loop by:

providing a first conductive loop element defined by an upper conductor of length A and a first conductive blade member of length C that tapers outwardly to form a flare portion adjacent a distal end of said upper conductor;

providing a second conductive loop element defined by a base conductor and a second conductive blade member that tapers outwardly to form a flare portion adjacent a distal end of said base conductor;

providing a back plate that extends between and connects the proximal ends of said upper and base conductors such that said first and second conductive loop elements are located adjacent to each other with the outer edges of the first and second conductive blade members face each other to define a notch therebetween which opens outwardly from a feed region at or adjacent said back plate;

providing an elongate conductive vane between a first location on said upper conductor and a second location on said first conductive blade to define a pair of loops within said first conductive loop element; and matching an impedance of said antenna component, at a desired operating frequency range, to a transmission line to be connected at said feed region thereof;

wherein said step of providing said first conductive loop element comprises:

selecting the length A of the upper conductor in accordance with the desired cut-off frequency;

selecting the length C of the first conductive blade and the length B of the portion of the back plate extending between said upper conductor and said first conductive blade such that the sum of lengths A, B and C is substantially equal to a wavelength at said desired cut-off frequency.

2. The method according to claim 1, further comprising selecting a predetermined performance characteristic of said antenna element, and wherein the step of providing said elongate conductive vane comprises:

selecting a minimum distance of said second location from said feed region at which said impedance match is maintained and said performance characteristic is attained, and placing said conductive vane within said first conductive loop element such that it extends from said selected second location on said first conductive blade to a first location on said upper conductor; and/or selecting an angle of inclination of said conductive vane within said first conductive loop at which said performance characteristic is attained, and placing said conductive vane at said selected angle of inclination between said first location on said upper conductor and said second location on said first conductive blade.

3. The method according to claim 2, including the step of selecting the second location as a function of the length of the upper conductor.

4. The method according to claim 3, wherein the second location on the first blade member is at least 1/6 of the length of the upper conductor.

5. The method according to claim 4, wherein the distance of the second location from the feed region is between 1/6 and 4/5 of the length of the upper conductor.

6. The method according to claim 1, wherein the conductive vane is inclined outwardly, away from the feed region, such that the distance of the first location from the proximal end of the upper conductor is greater than that of the second location from the feed region.

7. The method according to claim 1, wherein the conductive vane is curved along at least a portion of its length.

8. The method according to claim 2, comprising the step of selecting the distance of the first location from the proximal end of the upper conductor as a function of the length of the upper conductor and in accordance with the selected second location.

9. The method according to claim 8, wherein, when the distance of the second location from the feed region is 1/6 of the length of the upper conductor, the distance of the first location from the proximal end of the upper conductor is 1/5 or 1/4 of the length of the upper conductor.

10. The method according to claim 8, wherein the first location is between 1/5 and 5/6 along the length of the upper conductor from its proximal end.

11. The method according to claim 1, wherein said elongate conductive vane extends at an angle from said first location on said upper conductor to said second location on said first conductive blade member.

12. The method according to claim 1, wherein the step of providing said second conductive loop element comprises selecting the length of the base conductor in accordance with the desired cut-off frequency.

* * * * *